US011957258B2

(12) United States Patent
Chen

(10) Patent No.: US 11,957,258 B2
(45) Date of Patent: Apr. 16, 2024

(54) TOP ITEM HOLDER

(71) Applicant: Peng-Yuan Chen, Taichung (TW)

(72) Inventor: Peng-Yuan Chen, Taichung (TW)

( * ) Notice: Subject to any disclaimer, the term of this patent is extended or adjusted under 35 U.S.C. 154(b) by 406 days.

(21) Appl. No.: 17/421,275

(22) PCT Filed: Jan. 11, 2019

(86) PCT No.: PCT/CN2019/071243
§ 371 (c)(1),
(2) Date: Sep. 9, 2021

(87) PCT Pub. No.: WO2020/143008
PCT Pub. Date: Jul. 16, 2020

(65) Prior Publication Data

US 2022/0110471 A1 Apr. 14, 2022

(51) Int. Cl.
*A47G 29/087* (2006.01)
*A47G 25/06* (2006.01)

(52) U.S. Cl.
CPC ..... *A47G 29/087* (2013.01); *A47G 25/0614* (2013.01); *A47G 25/0642* (2013.01)

(58) Field of Classification Search
CPC .. A47G 29/087; A47G 7/044; A47G 25/0614; A47G 25/0642; A47G 25/0628; A47G 25/0678; A47J 47/20; A47H 27/00
USPC ..... 211/85.31, 119.008, 119.007, 11, 94.02, 211/85.29, 85.23, 88.03, 119.004; 248/340, 310, 311.3, 316.8, 316.4, 215, 248/692
See application file for complete search history.

(56) References Cited

U.S. PATENT DOCUMENTS 1,188,227 A * 6/1916 Woods et al. ..... A47G 1/1686 211/106.01
1,343,568 A * 6/1920 Leitch ..... A47G 7/044 47/40
2,006,169 A * 6/1935 Harris-Jones ..... A47K 3/004 211/119.011
2,151,510 A * 3/1939 Gorfein ..... D06F 57/127 211/119.008
2,609,936 A * 9/1952 Stamos ..... A47G 7/044 211/88.03
2,714,728 A * 8/1955 Bloch ..... A47K 3/001 248/231.21
2,969,154 A * 1/1961 Pelletier ..... A47J 47/16 211/85.31

(Continued)

FOREIGN PATENT DOCUMENTS

CN 201019268 Y 2/2008
CN 201341745 Y 11/2009

(Continued)

*Primary Examiner* — Jennifer E. Novosad
(74) *Attorney, Agent, or Firm* — Best & Flanagan LLP

(57) ABSTRACT

A top item holder is configured to be placed on top of a screen. The top item holder includes an anti-tilt device, at least one slider, a slide rail and at least one holder unit. The anti-tilt device is for preventing the top item holder from being relatively tilting with respect to the screen. The slide rail is disposed at a top of the anti-tilt device. The slider is slidably disposed on the slide rail and can slide in a sliding direction within a sliding travel. The holder unit is disposed on the slider. Thereby, top space of the screen can be effectively utilized, and relocation of the holder unit becomes more convenient.

3 Claims, 13 Drawing Sheets

(56) References Cited

U.S. PATENT DOCUMENTS 3,154,196 A * 10/1964 Loska, Jr. ..... A47G 23/0208 248/302
3,245,645 A * 4/1966 Dupler ..... A47G 25/0678 248/303
3,331,524 A * 7/1967 Wiley, Jr. ..... A47G 7/044 47/68
3,463,428 A * 8/1969 Kindorf ..... F16L 3/227 248/74.5
3,469,710 A * 9/1969 Vosbikian ..... E05B 73/02 248/222.51
4,048,754 A * 9/1977 Laux ..... A01G 9/02 217/65
4,123,024 A * 10/1978 Levy ..... A47K 10/04 248/228.2
4,146,138 A * 3/1979 Davis ..... A47F 7/147 248/231.71
4,296,959 A * 10/1981 Helbig ..... A47G 25/1457 294/169
4,428,488 A * 1/1984 McAvinn ..... A61B 50/37 211/112
4,869,378 A * 9/1989 Miller ..... F16M 13/00 248/225.11
4,894,935 A * 1/1990 Kretz ..... D06F 81/00 223/69
4,901,871 A * 2/1990 Ohm ..... D06F 57/127 211/119.004
5,031,783 A * 7/1991 Goudreau ..... A47F 5/083 248/222.51
5,180,067 A * 1/1993 Conaway ..... A47K 3/281 211/16
5,181,621 A * 1/1993 Plaehn ..... A47K 5/04 211/119.011
5,197,614 A * 3/1993 Dalton ..... A47F 5/0807 211/11
5,240,214 A * 8/1993 Birnbaum ..... F16M 11/12 248/214
5,480,116 A * 1/1996 Callas ..... G09F 7/08 248/340
5,547,156 A * 8/1996 Djuric ..... A47H 1/04 16/93 D
5,588,543 A * 12/1996 Finger ..... A47F 5/083 211/90.01
5,620,105 A * 4/1997 Macek ..... A47K 3/281 D6/525
5,799,428 A * 9/1998 Poindexter ..... G09F 1/103 40/658
5,822,918 A * 10/1998 Helfman ..... A47G 7/044 248/231.41
5,823,366 A * 10/1998 Bellamy ..... A47K 10/04 211/119.011
5,893,469 A * 4/1999 Nozawa ..... A47K 1/05 248/129
5,971,167 A * 10/1999 Finbow ..... A47G 23/0208 211/85.29
5,984,249 A * 11/1999 Cohen ..... A47G 7/044 248/205.2
6,052,918 A * 4/2000 Oletzke ..... D06F 57/12 248/220.21
6,227,384 B1 * 5/2001 Saylor ..... A47B 17/033 211/11
6,336,564 B1 * 1/2002 Garnier ..... A47F 5/0068 211/94.02
6,370,741 B1 * 4/2002 Lu ..... A47B 21/045 24/523
6,516,958 B2 * 2/2003 Tyski ..... A47B 96/025 211/186
6,843,381 B2 * 1/2005 Wu ..... A47B 81/04 211/85.29
6,945,414 B1 * 9/2005 Stevens ..... A47F 5/0846 211/183
7,210,659 B2 * 5/2007 Lawson ..... D06F 95/004 211/94.01
7,523,900 B1 * 4/2009 Hlatky ..... A61G 7/0503 248/200.1
7,810,654 B1 * 10/2010 Wang ..... A47G 25/06 211/106.01
7,815,059 B2 * 10/2010 Mulholland ..... A47F 7/0078 211/85.23
7,832,568 B2 * 11/2010 Wu ..... A47B 81/04 211/85.29
7,950,533 B2 * 5/2011 Adams ..... A47F 5/01 211/113
8,186,521 B2 * 5/2012 Yu ..... A47F 5/13 211/90.03
8,496,125 B2 * 7/2013 Chen ..... A47F 7/28 211/49.1
8,752,715 B1 * 6/2014 Dimock ..... A47L 19/04 206/562
8,763,971 B1 * 7/2014 Wilson ..... A61M 16/021 211/113
8,991,639 B2 * 3/2015 Kells ..... B65D 1/36 220/570
D861,270 S * 9/2019 Catania ..... D32/40
10,555,606 B2 * 2/2020 Fischer ..... A47B 73/004
10,874,269 B2 * 12/2020 Bongiorno ..... F16M 11/24
11,248,741 B1 * 2/2022 Parniani ..... A01G 5/04
2004/0079717 A1 * 4/2004 Klein ..... A47B 96/16 211/119.004
2004/0173550 A1 * 9/2004 Adams ..... A47G 25/0614 211/119.004
2006/0043038 A1 * 3/2006 Wetzel ..... A47F 7/0078 211/88.03
2006/0289372 A1 * 12/2006 Yang ..... A47L 19/02 211/41.3
2007/0246434 A1 * 10/2007 Adams ..... A47F 5/01 211/8
2008/0164384 A1 * 7/2008 Rosen ..... D06F 79/02 211/106
2008/0190873 A1 * 8/2008 Rockel ..... D06F 57/12 211/119.011
2008/0302943 A1 * 12/2008 Lunato ..... A47G 7/044 248/558
2010/0133218 A1 * 6/2010 Yang ..... A47K 1/09 29/428
2011/0163054 A1 * 7/2011 Yu ..... A47B 57/06 211/94.02
2011/0226712 A1 * 9/2011 Morton ..... F41A 23/18 211/119.004
2012/0266377 A1 * 10/2012 Eilmus ..... E03C 1/186 211/70.7
2015/0076086 A1 * 3/2015 Tsai ..... A47B 57/586 211/11
2022/0110471 A1 * 4/2022 Chen ..... A47G 25/0614

FOREIGN PATENT DOCUMENTS

CN 203969640 U 12/2014
CN 204071621 U 1/2015
CN 204838496 U 12/2015
CN 205234217 U 5/2016
CN 106264033 A 1/2017
CN 205871581 U 1/2017
CN 206350648 U 7/2017
CN 206910029 U 1/2018
DE 202019005737 U1 * 10/2021 ..... F16M 13/00
JP 2004243066 A 9/2004
WO WO-2013043116 A1 * 3/2013 ..... A47G 25/0642
WO WO-2020143008 A1 * 7/2020 ..... A47G 29/087

* cited by examiner

TOP ITEM HOLDER

BACKGROUND OF THE INVENTION

Field of the Invention

The present invention relates to an item holder, and more particularly to an item holder for placing on top of a screen.

Description of the Prior Art

In the fields of interior design, landscape design, office furniture and home furniture, screens such as railings, fences and partitions are generally planned to separate different spaces. These screens have a common feature in that their width is usually not too wide to avoid taking up too much space.

Due to the insufficient width, the top space of the screen is usually difficult to utilize. For example, it is not suitable for placing items on the top space of seats and desktop screens in offices. Although there are a few people who place potted plants or objects on a slightly wider fence, the potted plants or objects, if not securely fastened, may fall off the fence when strong winds or earthquakes occur. This can cause damage to the potted plants or objects, or damage the pedestrians or property below. It is especially dangerous when the potted plants or objects are placed on the surrounding walls by the balconies of high-rise buildings.

SUMMARY OF THE INVENTION

One object of the present invention is to provide a top item holder that can be placed on the top of the screen and can prevent the item from falling.

To achieve the above and other objects, the present invention provides a top item holder for placing on top of a screen. The top item holder includes an anti-tilt means, at least one slider, a slide rail and at least one holder unit. The anti-tilt means is for preventing the top item holder from being relatively tilting with respect to the screen. The slide rail is disposed at a top of the anti-tilt means. The slider is slidably disposed on the slide rail and can slide in a sliding direction within a sliding travel. The holder unit is disposed on the slider.

Accordingly, the holder unit can be securely positioned on the top of the screen so that the top space of the screen can be utilized. Furthermore, the position of the holder unit can be conveniently adjusted, and it is helpful to realize the rapid replacement of the holder unit. Therefore, the present invention can solve the shortcomings of the prior art and meet the potential needs of users.

DETAILED DESCRIPTION OF THE PREFERRED EMBODIMENTS

Figure 1:
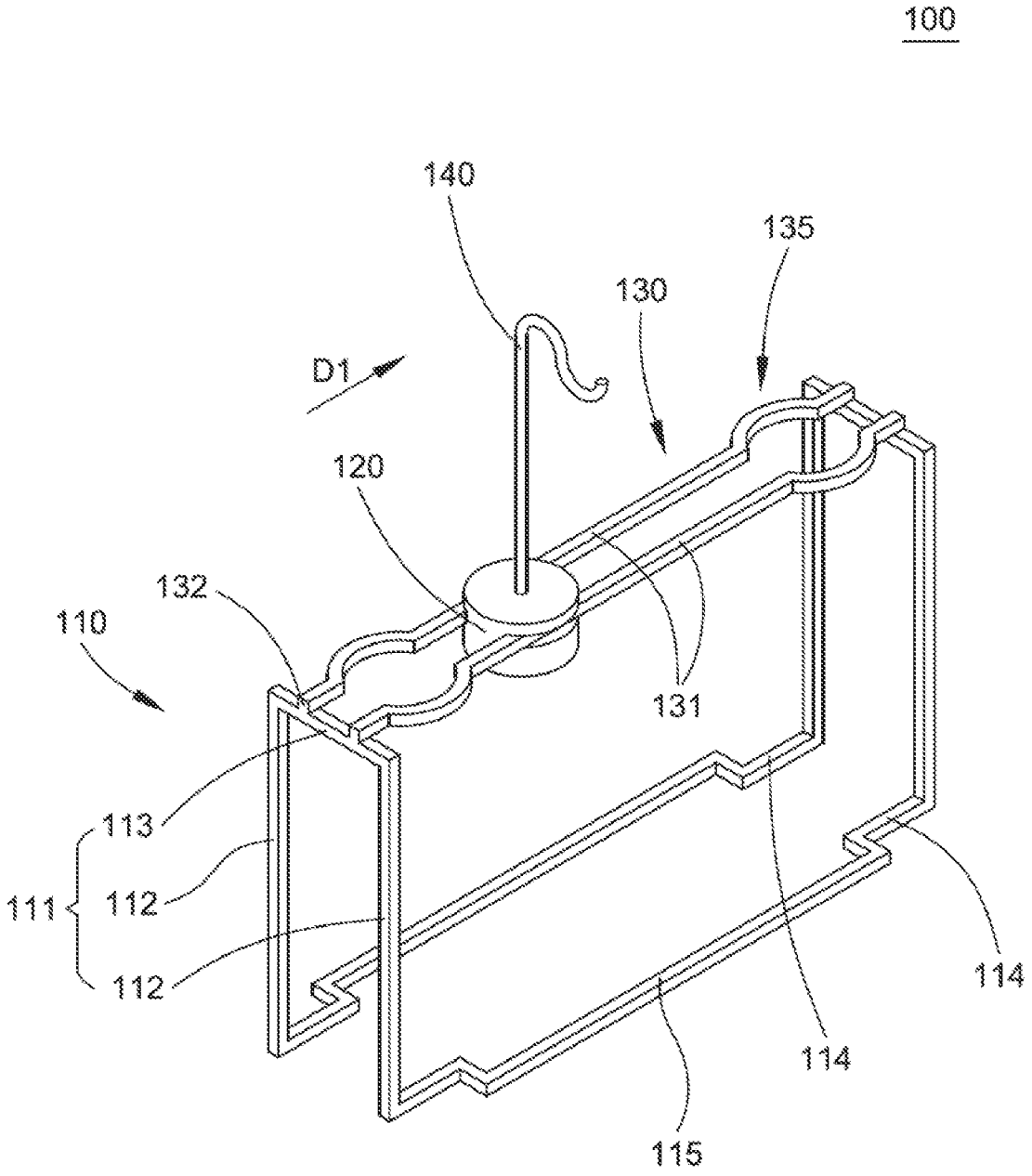
FIG. 1 is a perspective view of the first embodiment of the present invention.
Figure 2:
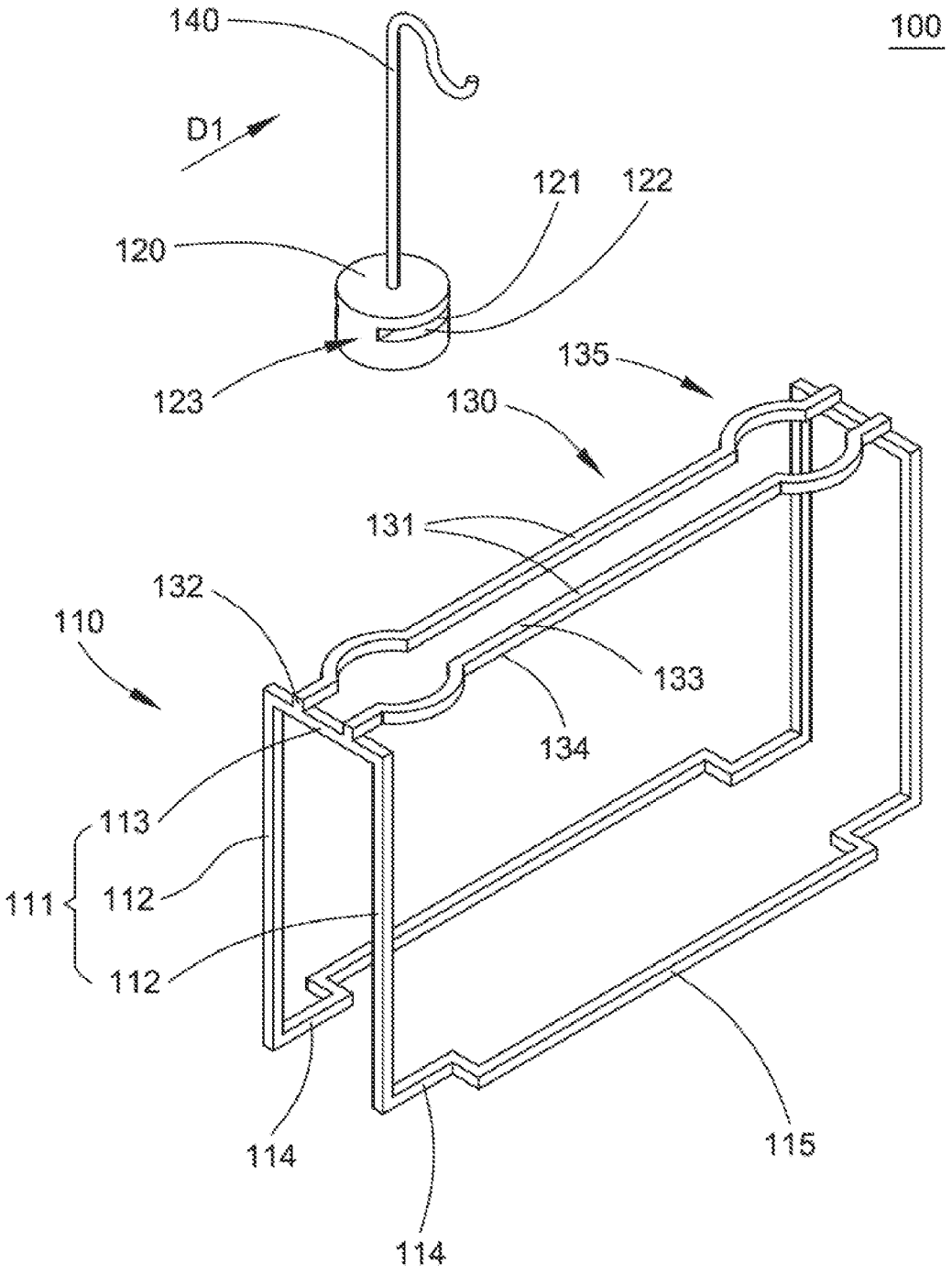
FIG. 2 is an explosive view of the first embodiment of the present invention.

Please refer to FIGS. 1 and 2 for the first embodiment of the present invention. The present embodiment provides a top item holder 100 having an anti-tilt means 110, a slider 120, a slide rail 130 and a holder unit 140.

The anti-tilt means 110 is used for preventing the top item holder 100 from relatively tilting with respect to a screen where the top item holder 100 is placed on, so that the to item holder can be securely fixed on top of the screen. In the present embodiment, the anti-tilt means includes a pair of n-shaped clamps 111. The clamps 111 each has a pair of parallel jaws 112 and an upper portion 113 connecting the jaws 112. In the present embodiment, the jaws and the upper portion are all in bar shape. The jaws 112 are extended downward from two opposite ends of the upper portion 113. To increase clamping ability and the mechanical strength, the anti-tilt means further has a pair of parallel support rods 114, each connects one of the jaws 112 of the clamps 111 with one of the jaws 112 of the other clamp 111. In the present embodiment, the support rods 114 are all connected to, but not limited to, lower ends of the jaws 112. In addition, the support rods 114 each has a protruding section 115 which protrudes away from the other support rods 114. Thereby, the clamps 111 can clamp on top of the screen to prevent the top item holder from tilting, while the protruding sections 115 can be used for the user to hang additional items.

Figure 3:
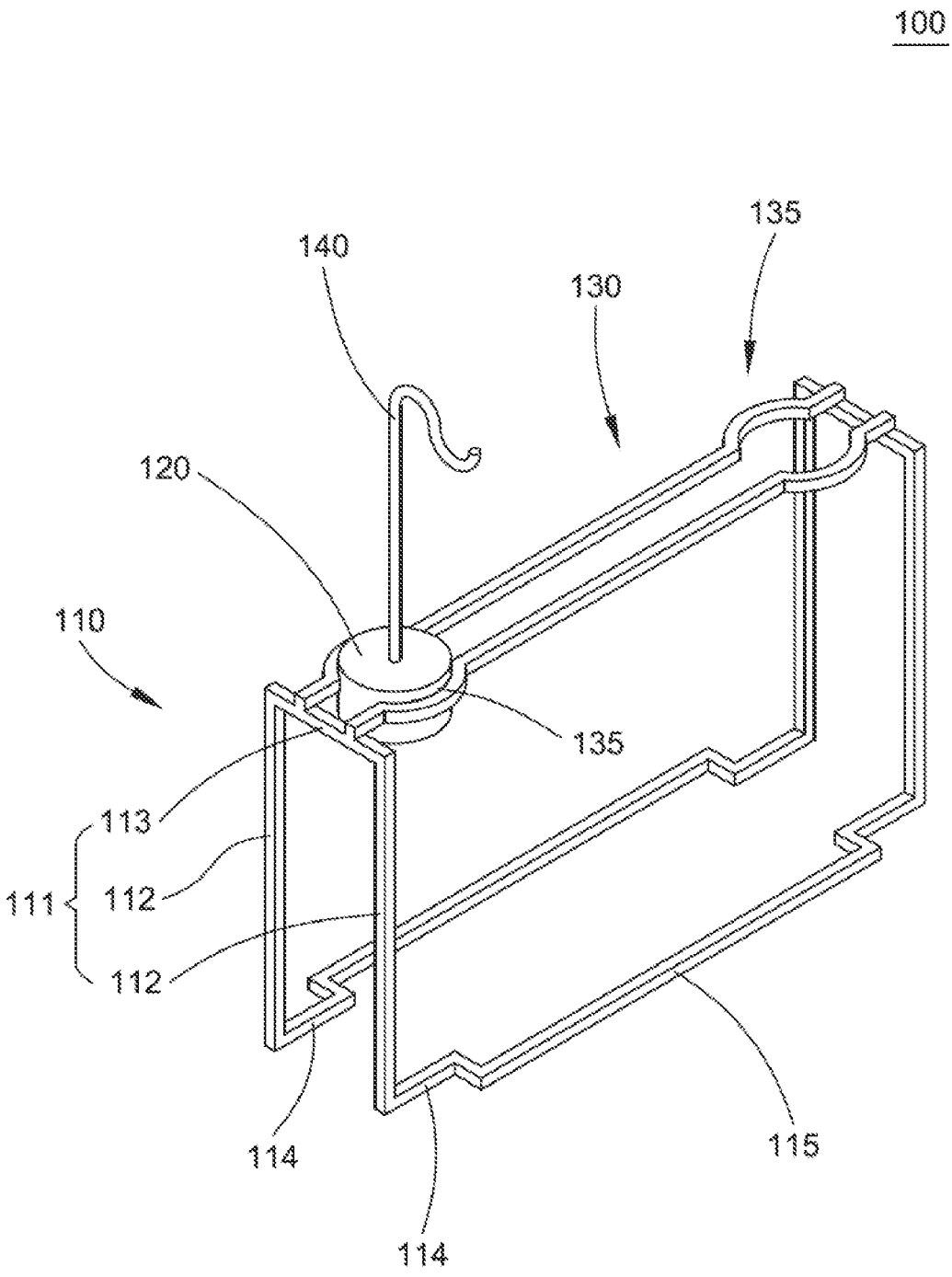
FIG. 3 is another perspective view of the first embodiment of the present invention showing the installation of the top item holder.
Figure 4:
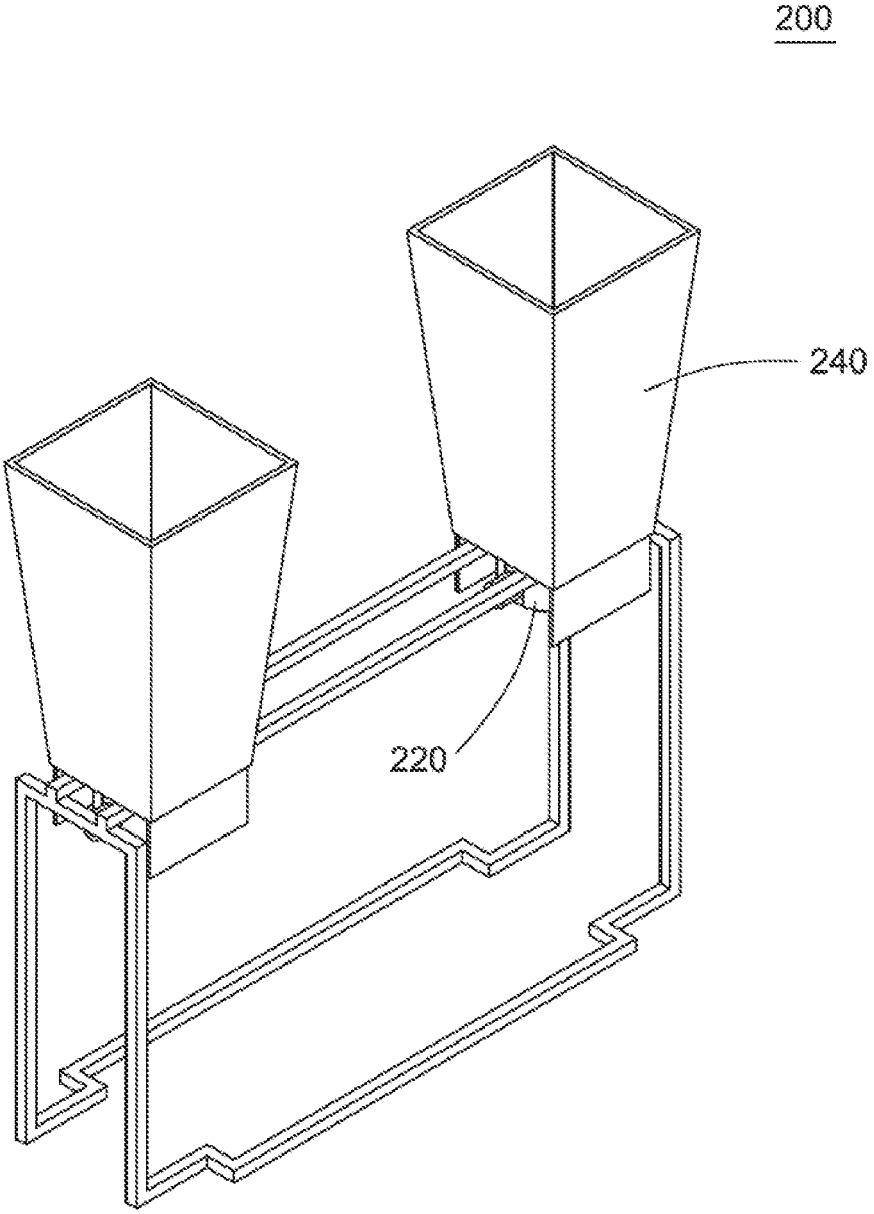
FIG. 4 is a perspective view of the second embodiment of the present invention.

The slide rail 130 is disposed on the upper portion 113 of the anti-tilt means 110. The slider 120 is slidably disposed on the slide rail 130 and is capable of sliding in a sliding direction D1 within a sliding travel. In the present embodiment, the slide rail 130 has a pair of parallel rail bars 131, each having two opposite ends connecting to the upper portion 113 of the clamps 111 via two vertical connecting sections 132. The sliding travel lies between the two connecting sections 132. The slide rail 130 further has a first upper abutment surface 133 and a first lower abutment surface 134. The slider 120 has a pair of parallel grooves 123. The rail bars 131 are respectively slidably embedded in the grooves 123. The slider 120 further has a second lower abutment surface 121 and a second upper abutment surface 122. In normal use, the second lower abutment surface 121 abuts against the first upper abutment surface 133 by gravity, and the first lower abutment surface 134 faces toward the second upper abutment surface 122 to limit the vertical displacement of the slider 120 so as to prevent the slider 120 from disengaging from the slide rail 130 in the vertical direction. On the other hand, the slide rail 130 also has two openings 135 located in the sliding travel and adapted for the slider 120 to escape from the sliding travel, as shown in FIG. 3. In this way, the user can arbitrarily replace the slider 120 and the holder unit 140 disposed thereon at any time. It should be noted that the number of the openings can be increased or decreased as required.

The holder unit 140 is disposed on the slider 120 to allow the user to place items on the slider 120. In the present embodiment, the holder unit is a hook extending upward.

Figure 5:
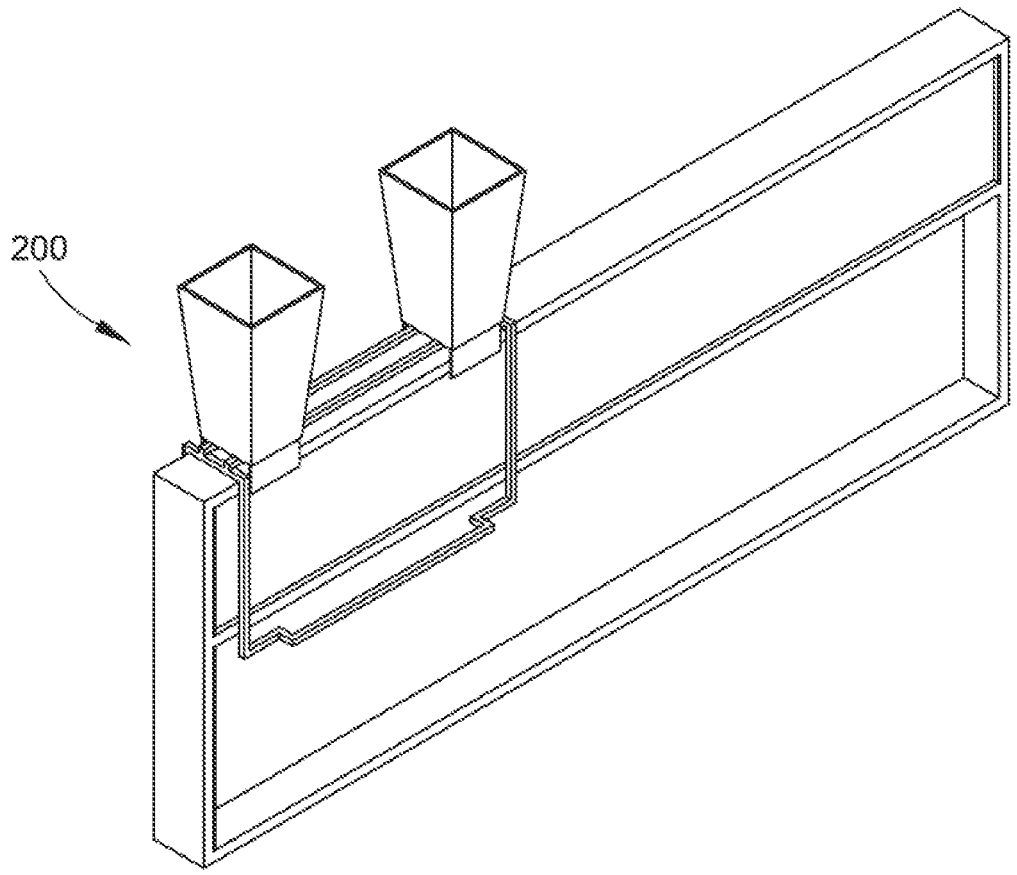
FIG. 5 is a perspective view of the second embodiment of the present invention installed on a screen.

Please refer to FIG. 2 for the second embodiment of the present invention. The top item holder 200 of the present embodiment is similar to that of the first embodiment. The difference is that the top item holder has a plurality of sliders 220 and holder units 240. In the present embodiment, the holder units 240 are flowerpots for holding cultivation soil and plants. Please also refer to FIG. 5, when the top item holder 200 is installed on top of screens, partitions, etc., it can make good use of the space, allowing users to achieve a green a beautifying effect even in a small office environment. There is no need to occupy the work desk, and at the same time, there is no need to worry about the flowerpots and other storage units falling over due to collision or vibration. Not only does it not need to occupy the work desk, but also there is no need to worry about the flowerpots and/or other holder units falling over due to collision or vibration. In other possible embodiments, the number of sliders and holder units can be arbitrarily increased or decreased according to requirements, and the appearance of the holder unit is not limited to the illustrated embodiment. For example, the holder unit may also be a storage basket, a pen holder, or other mechanisms which can accommodate, carry, attach, insert or stick items.

Figure 6:
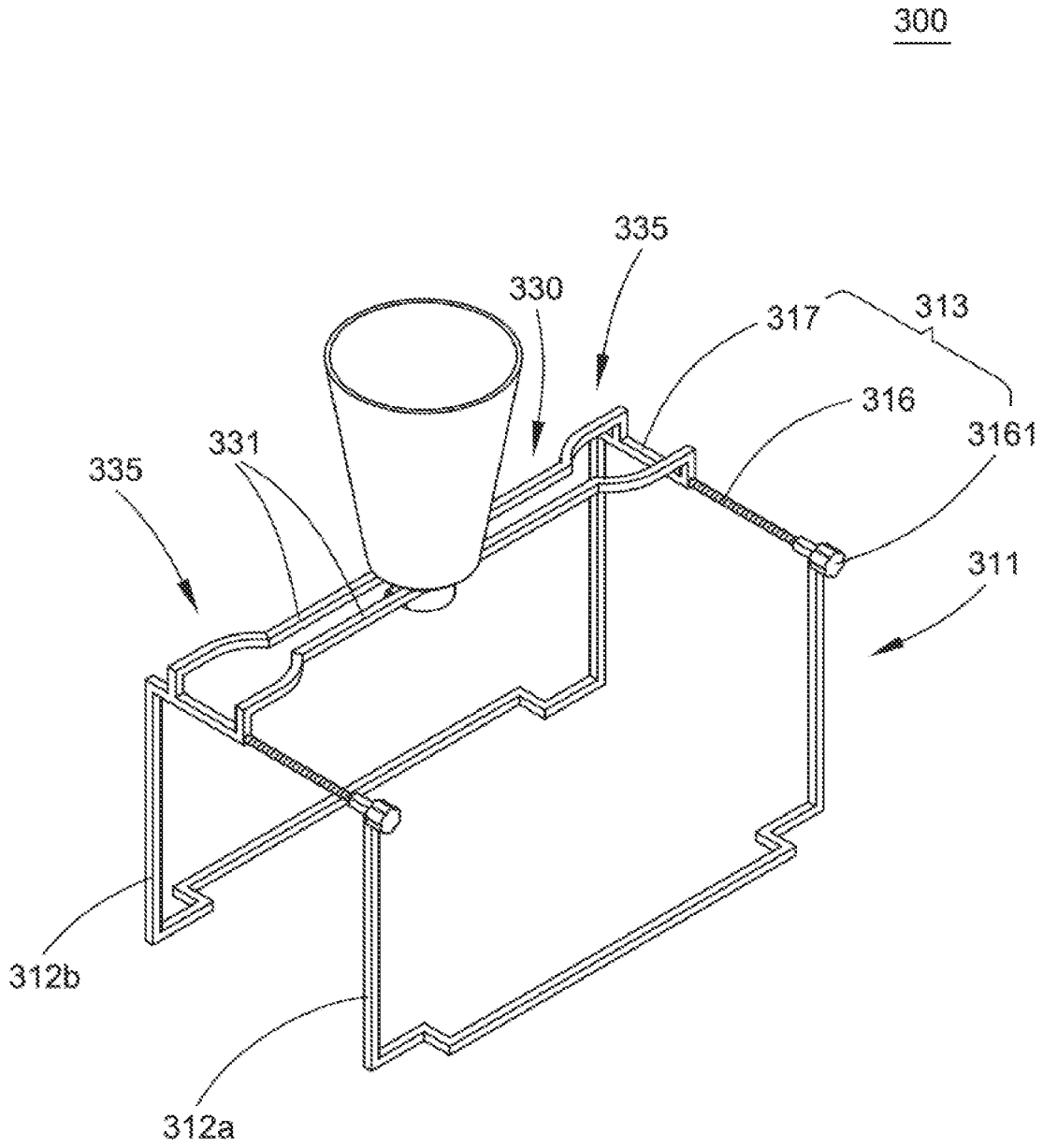
FIG. 6 is a perspective view of the third embodiment of the present invention.
Figure 7:
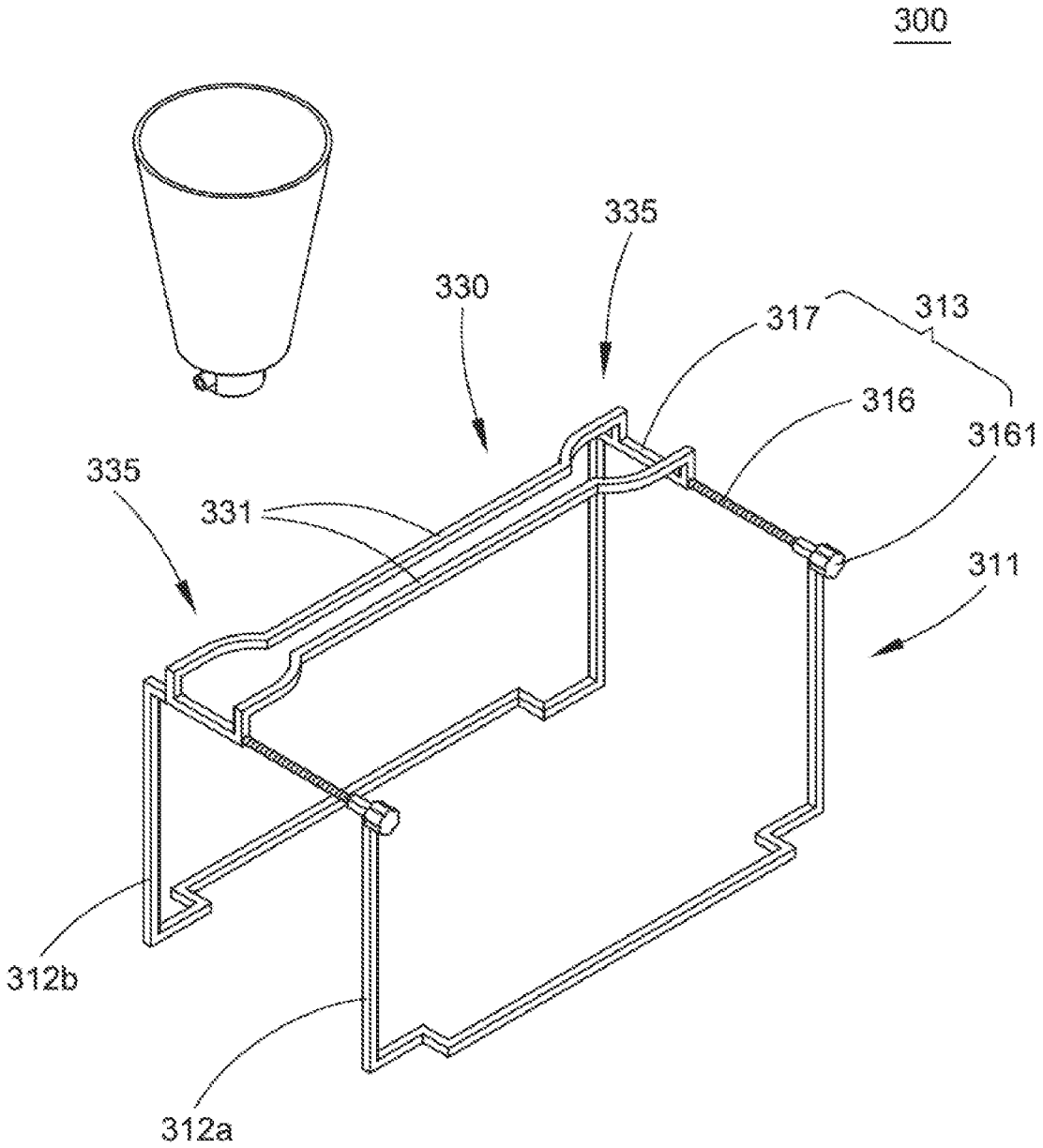
FIG. 7 is an explosive view of the third embodiment of the present invention.
Figure 8:
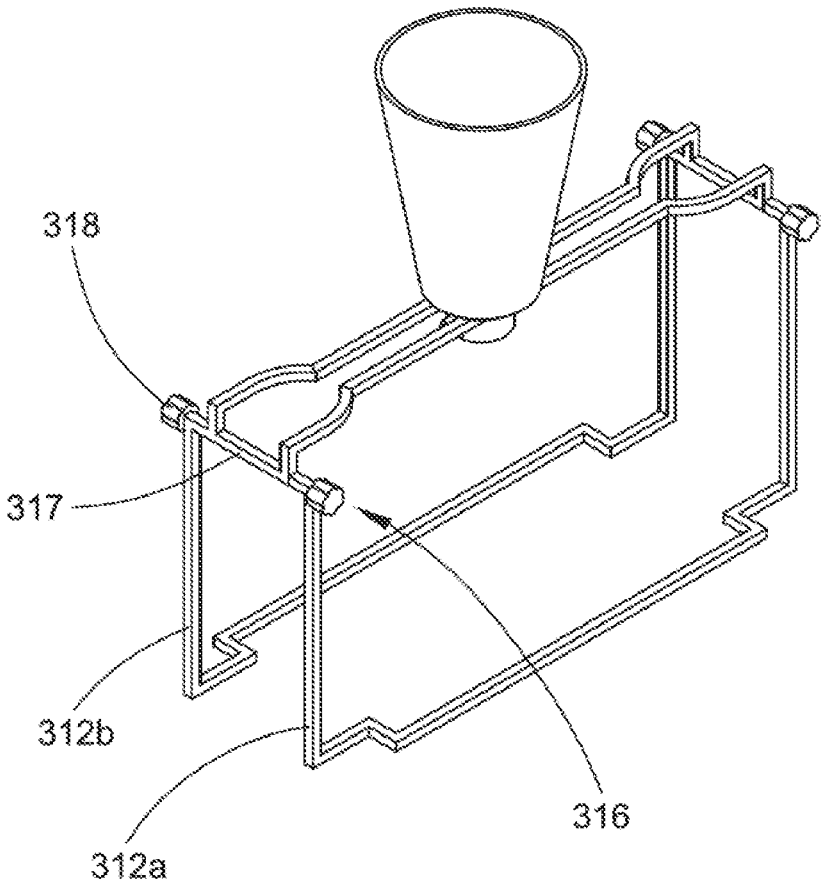
FIG. 8 is another perspective view of the third embodiment of the present invention.
Figure 9:
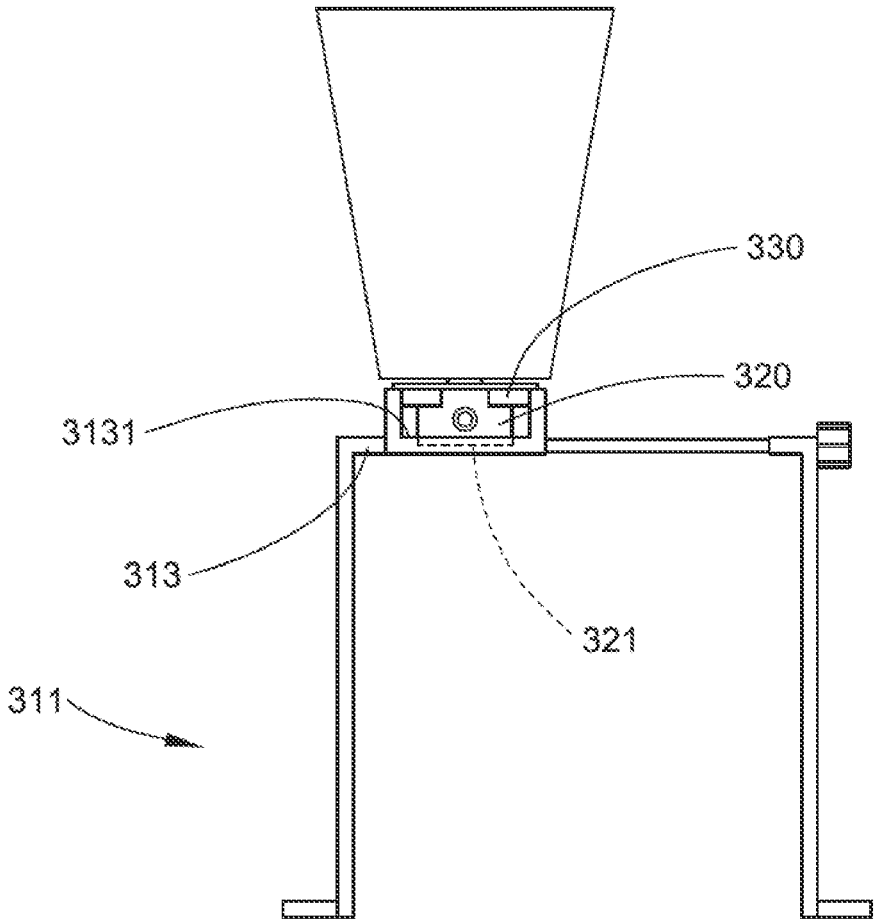
FIG. 9 is a side view of the third embodiment of the present invention.

Please refer to FIGS. 6 and 7 for the third embodiment of the present invention. The top item holder 300 is similar to that of the prior embodiment. The difference is that the openings 335 of the sliding rail 330 are respectively located at two opposite ends of the rail bars 331, and the sliding travel is located between the two openings 335. In addition, the upper portions 313 of the clamps 311 each has a screw 316 and a screw sleeve 317. The screw 316 is disposed on the jaw 312*a*, and the screw sleeve 317 is disposed on the other jaw 312*b*. The rail bars 331 are disposed on the screw sleeve 317. The screw sleeve 317 has internal threads, and the screw 316 can be screwed on the screw sleeve 317. One end of the screw 316 is provided with a knob 3161 for the user to rotate and adjust the spacing between the pair of jaws 312*a* and 312*b*, so that the clamp 311 can be applied to screens of different widths, and can be kept stable without tilting. As shown in FIG. 8, when the screw 316 completely penetrates the screw sleeve 317, the distal end of the screw 316 can be screwed with a nut 318, so that the pair of jaws 312*a* and 312*b* have a preset minimum spacing. As shown in FIG. 9, the upper portion 313 of the clamp 311 has a top surface 3131, and the slider 320 has a bottom surface 321. When the slider 320 is slidably disposed on the slide rail 330, the top surface 3131 of the upper portion 313 of the clamp 311 is higher than the bottom surface 321 of the slider 320. In this way, the slider 320 will be blocked by the upper portion 313 of the clamp 311 when it slides horizontally to either end of the sliding travel, which can prevent the slider 320 from accidentally sliding out of the slide rail 330 horizontally. Thereby, the slider 320 can only be taken out by the user through the openings.

Figure 10:
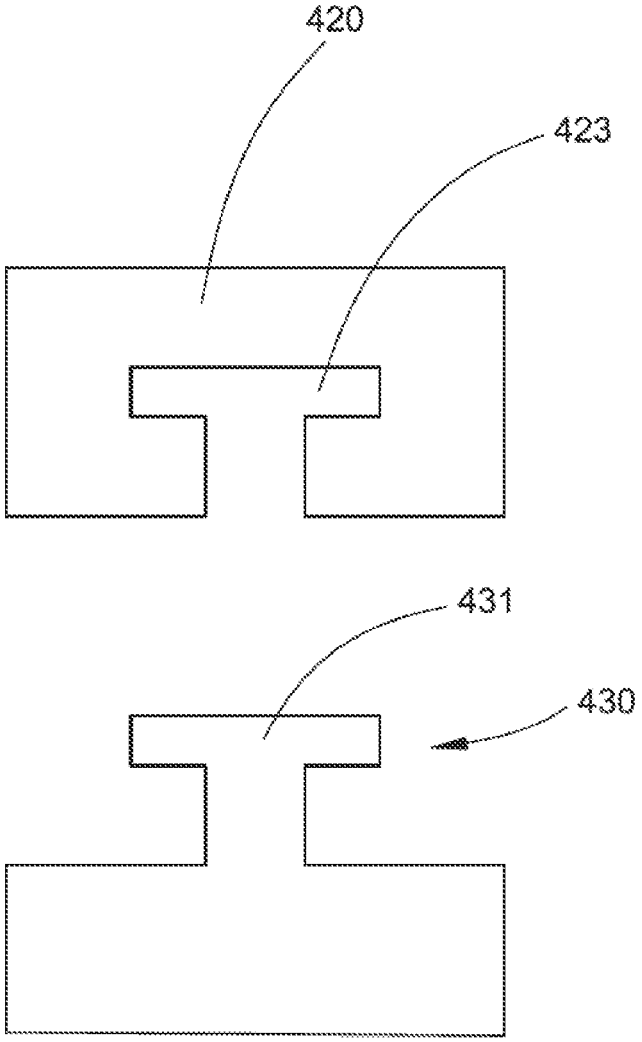
FIG. 10 is a side view of the fourth embodiment of the present invention.

In the foregoing embodiments, the slide rails all have a pair of rail bars. In the fourth embodiment shown in FIG. 10, the slide rail 430 only has a single T-shaped rail bar 431, and the slider 420 has a single T-shaped groove 423. The rail bar 431 is also slidably embedded in the groove 423 so that the slider 420 can still slide freely within the sliding travel but cannot arbitrarily separated from the slide rail 430 in the vertical direction. In other possible embodiments, the anti-tilting means may also be nails for driving into the screen, screws for screwing on the screen or other fixing methods such as welding, gluing, snapping, magnetic attraction, fitting or setting bolts.

Figure 11:
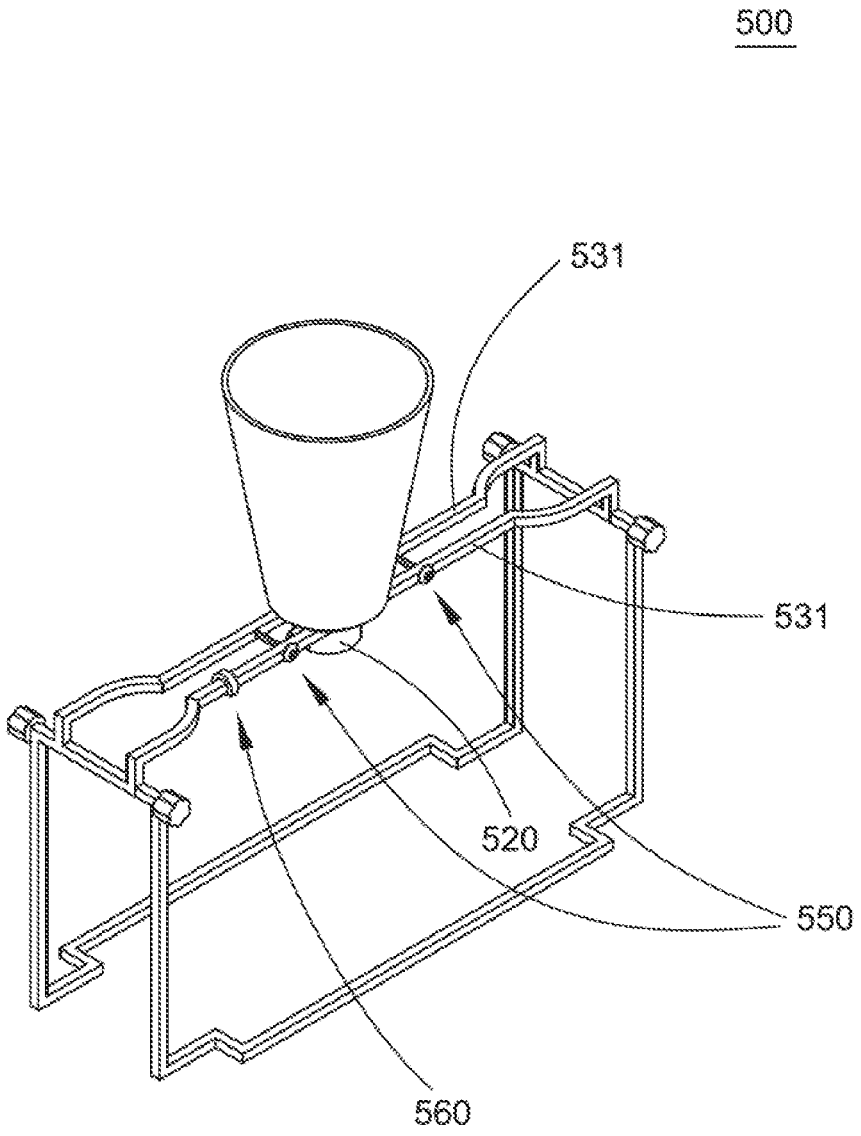
FIG. 11 is an explosive view of the fifth embodiment of the present invention.
Figure 12:
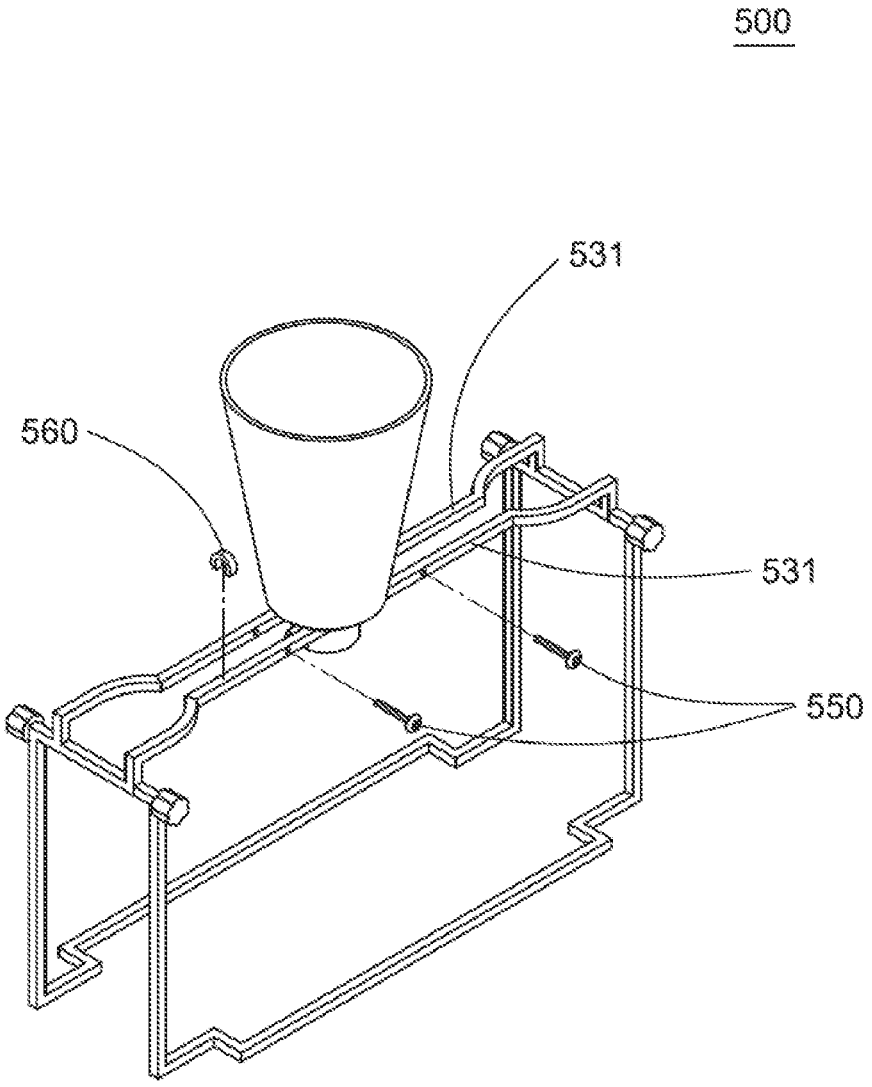
FIG. 12 is a perspective view of the fifth embodiment of the present invention.

Please refer to FIGS. 11 and 12 for the fifth embodiment of the present invention. The top item holder of the present embodiment further includes at least one limit screw 550. At least one of the rail bars 531 further has at least one screw hole and/or through hole within the sliding travel. The limit screw 550 can pass through one of the through holes in a width direction of the rail bars 531 and be screwed to the screw hole formed on the other rail bar 531. The limit screw 550 can be used to limit the sliding travel of the slider 520 to prevent the slider 520 from leaving the slide rail. The width direction is perpendicular to the sliding direction. In addition, the top item holder 500 further includes a C-shaped snap ring 560 capable of being snapped on one of the rail bars 531, which can also be used to limit the sliding travel of the slider 520.

Figure 13:
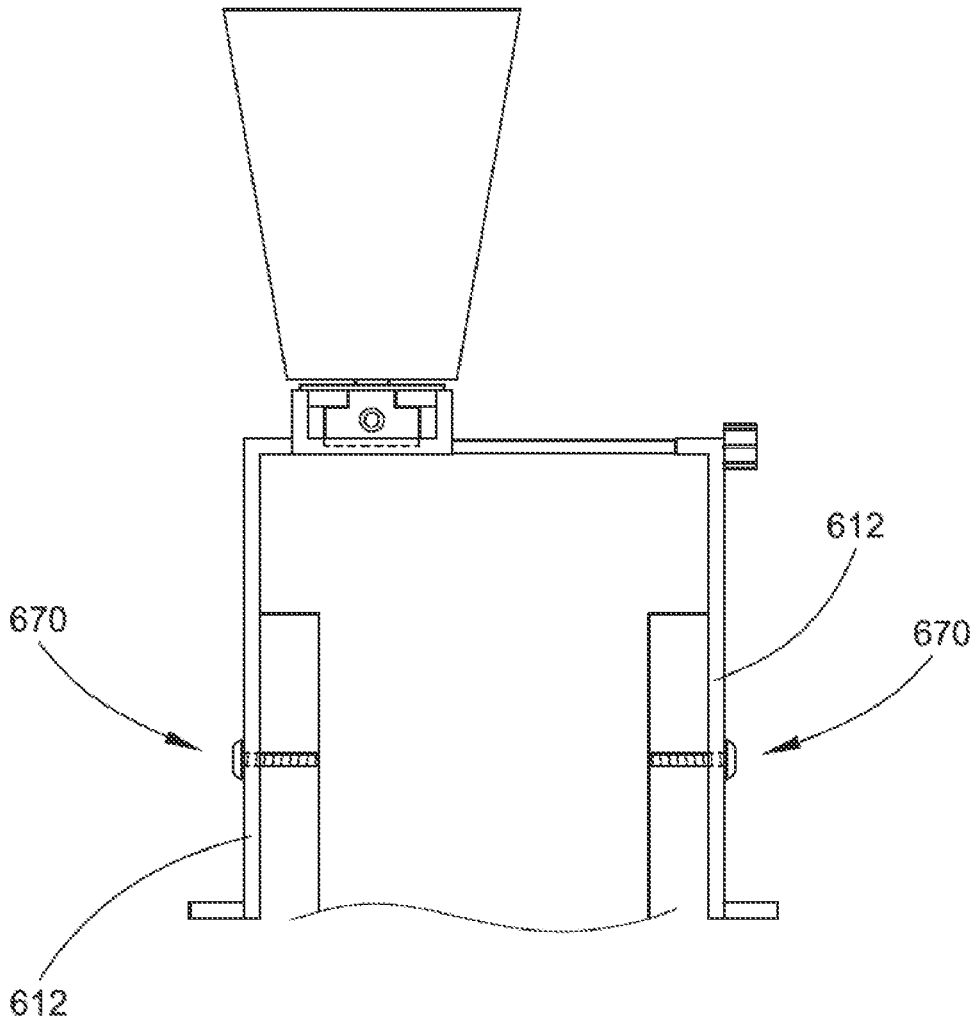
FIG. 13 is a side view of the sixth embodiment of the present invention installed on a screen.

Please refer to FIG. 13 for the sixth embodiment of the present invention. The anti-tilt means of the present embodiment further includes at least one side screw 670, and the jaws 612 can be formed with one or more screw holes at different heights. Each of the side screws 670 can be screwed in one of the screw holes, and distal ends of the side screws 670 are adapted to abut against a side surface of the screen. The top item holder of the present embodiment is particularly suitable for screens with a wide top and a narrow lower structure, thereby preventing the top item holder from tilting.

In summary, the top item holder of the present invention is not only simple in structure, but also allows users to utilize the top space of the screens. In addition, the replacement of the slider and the holder unit is very simple. By sliding the slider out of the slide rail through the opening, the slider can be replaced quickly and at any time. All in all, the present invention can solve the shortcomings of the prior art and meet the potential needs of users.

What is claimed is:

1. A top item holder for placing on a top of a screen, comprising:

an anti-tilt means for preventing the top item holder from relatively tilting with respect to the screen;

at least one slider;

a slide rail, disposed on an upper portion of the anti-tilt means, the at least one slider being slidably disposed on the slide rail and being capable of sliding in a sliding direction within a sliding travel; and at least one holder unit, disposed on the at least one slider respectively, wherein, the slide rail has a first upper abutment surface and a first lower abutment surface, the at least one slider has a second lower abutment surface and a second upper abutment surface, the second lower abutment surface being adapted to abut against the first lower abutment surface, the second upper abutment surface faces toward the first lower abutment surface and is adapted to limit a vertical movement of the at least one slider, and wherein, the least one slider is removably disposed on the slide rail, the slide rail has an opening located in the sliding travel and adapted for the at least one slider to escape from the sliding travel;

wherein the anti-tilt means comprises at least one n-shaped clamp, the clamp has a pair of jaws parallel to each other and the upper portion connecting the jaws;

wherein the anti-tilt means has a pair of said clamps and a pair of support rods parallel to each other, each of the support rods connects one of the jaws of one of the clamps with one of the jaws of the other said clamp.

2. The top item holder of claim 1, wherein each of the support rods has a protruding section which protrudes away from the other said support rods.

3. The top item holder of claim 1, wherein the sliding direction is perpendicular to a width direction of the holder.

* * * * *